US011537080B2

(12) United States Patent
Bifrare et al.

(10) Patent No.: US 11,537,080 B2
(45) Date of Patent: Dec. 27, 2022

(54) TIMEPIECE DISPLAY MECHANISM WITH A RESILIENT HAND

(71) Applicant: Montres Breguet S.A., L'Abbaye (CH)

(72) Inventors: Christophe Bifrare, Le Pont (CH); Alain Zaugg, Le Sentier (CH); Patrice Golay, Le Sentier (CH); Marc Stranczl, Nyon (CH)

(73) Assignee: Montres Breguet S.A., L'Abbaye (CH)

( * ) Notice: Subject to any disclaimer, the term of this patent is extended or adjusted under 35 U.S.C. 154(b) by 469 days.

(21) Appl. No.: 16/820,791

(22) Filed: Mar. 17, 2020

(65) Prior Publication Data

US 2021/0011433 A1 Jan. 14, 2021

(30) Foreign Application Priority Data

Jul. 12, 2019 (EP) ..... 19185917

(51) Int. Cl.
*G04B 19/04* (2006.01)
*G04B 19/02* (2006.01)
(Continued)

(52) U.S. Cl.
CPC ..... *G04B 19/02* (2013.01); *G04B 9/005* (2013.01); *G04B 13/001* (2013.01);
(Continued)

(58) Field of Classification Search
CPC .... G04B 19/02; G04B 19/048; G04B 19/082; G04B 19/042; G04B 9/005; G04B 13/008;
(Continued)

(56) References Cited

U.S. PATENT DOCUMENTS 3,952,500 A * 4/1976 Tomura ..... G04B 45/0007 368/229
4,601,585 A * 7/1986 Farley ..... G04B 19/042 368/80
(Continued)

FOREIGN PATENT DOCUMENTS

CN 1808310 A 7/2006
CN 201576169 U 9/2010
(Continued)

OTHER PUBLICATIONS

Combined Chinese Office Action and Search Report dated May 31, 2021 in corresponding Chinese Patent Application No. 202010233315.6 (with English Translation of Category of Cited Documents), 7 pages.
(Continued)

*Primary Examiner* — Sean Kayes
(74) *Attorney, Agent, or Firm* — Oblon, McClelland, Maier, Neustadt, L.L.P.

(57) ABSTRACT

A timepiece display mechanism with a resilient hand including a first and second device for driving, about an output axis, a first and a second pipe mounted at the ends of a flexible strip, and including a display index distant from the pipes, these drive devices being arranged to deform the flexible strip, by varying the angular position of one pipe with respect to the other about the output axis, and to vary the radial position of the display index with respect to this axis, this mechanism includes a first differential on the drive train of the first pipe, one input of which is formed by a first cam, and a second differential on the drive train of the second pipe, one input of which is formed by a second cam.

19 Claims, 6 Drawing Sheets

(51) Int. Cl.

| | |
|---|---|
| ***G04B 13/00*** | (2006.01) |
| ***G04B 45/00*** | (2006.01) |
| ***G04B 9/00*** | (2006.01) |
| ***G04B 13/02*** | (2006.01) |
| ***G04B 19/08*** | (2006.01) |

(52) U.S. Cl.
CPC ..... *G04B 13/007* (2013.01); *G04B 13/008* (2013.01); *G04B 13/021* (2013.01); *G04B 19/042* (2013.01); *G04B 19/048* (2013.01); *G04B 19/082* (2013.01); *G04B 45/0061* (2013.01); *G04B 13/02* (2013.01)

(58) Field of Classification Search
CPC .... G04B 13/001; G04B 13/007; G04B 13/02; G04B 13/021; G04B 45/0061
See application file for complete search history.

(56) References Cited

U.S. PATENT DOCUMENTS

| | | | | |
|---|---|---|---|---|
| 4,671,670 | A | 6/1987 | Kruener | |
| 4,995,021 | A * | 2/1991 | Sullivan | G04B 45/00 368/233 |
| 5,172,350 | A * | 12/1992 | Walen | G04B 19/04 368/228 |
| 9,075,392 | B2 * | 7/2015 | Stranczl | G04B 45/0061 |
| 10,222,749 | B2 * | 3/2019 | Denden | G04B 45/0061 |
| 10,444,708 | B2 * | 10/2019 | Cardot | G04B 19/06 |
| 2015/0016232 | A1 * | 1/2015 | Graemiger | G04F 7/0871 368/132 |
| 2015/0109891 | A1 | 4/2015 | Stranczl | |
| 2017/0351219 | A1 | 12/2017 | Paratte et al. | |
| 2018/0341224 | A1 * | 11/2018 | Alagon Carrillo | G04B 13/005 |
| 2018/0341227 | A1 * | 11/2018 | Alagon Carrillo | G04B 13/001 |
| 2021/0026305 | A1 * | 1/2021 | Stranczl | G04B 13/007 |
| 2021/0048782 | A1 * | 2/2021 | Stranczl | G04B 13/001 |
| 2021/0223740 | A1 * | 7/2021 | Stranczl | G04B 19/042 |
| 2021/0373497 | A1 * | 12/2021 | Bifrare | G04B 13/007 |

FOREIGN PATENT DOCUMENTS

| | | | |
|---|---|---|---|
| CN | 203982086 | U | 12/2014 |
| CN | 104570687 | A | 4/2015 |
| CN | 207380448 | U | 5/2018 |
| CN | 108279557 | A | 7/2018 |
| CN | 109839814 | A | 6/2019 |
| CN | 208984958 | U | 6/2019 |
| EP | 0 211 285 | | 2/1987 |
| EP | 1 710 637 | A2 | 10/2006 |
| EP | 2 863 274 | A1 | 4/2015 |

OTHER PUBLICATIONS

International Search Report dated Oct. 8, 2019 in European Application 19185917.2 filed Jul. 12, 2019 (with English Translation of Categories of Cited Documents), 5 pages.

* cited by examiner

TIMEPIECE DISPLAY MECHANISM WITH A RESILIENT HAND

CROSS-REFERENCE TO RELATED APPLICATION

This application claims priority to European Patent Application No. 19185917.2 filed on Jul. 12, 2019, the entire disclosure of which is hereby incorporated herein by reference.

FIELD OF THE INVENTION

The invention concerns a timepiece display mechanism of variable geometry, comprising at least one resilient hand which includes a first drive pipe integral with a first end of a flexible strip, and a second drive pipe integral with another end of said flexible strip, and comprising a display index which, in an unconstrained free state of said resilient hand in which said first pipe and said second pipe are not subject to any stress and are distant from each other, is distant from said first pipe and said second pipe, the operating position of said resilient hand being a stressed position wherein said first pipe and said second pipe are coaxial to one another about an output axis, said display mechanism comprising first means for driving said first pipe about said output axis, and second means for driving said second pipe about said output axis, said first drive means and said second drive means being arranged to deform said flexible strip, by varying the angular position of said second pipe with respect to the angular position of said first pipe about said output axis, and to vary the radial position of said display index with respect to said output axis.

The invention concerns a timepiece movement including at least one such display mechanism.

The invention concerns a watch including at least one such movement and/or at least one such display mechanism.

The invention concerns the field of timepiece display mechanisms, and more particularly for timepieces with complications. The invention can be used both for static timepieces, such as pendulums or clocks, and for watches, due to the small dimensions of the mechanism of the invention.

BACKGROUND OF THE INVENTION

It is important for the user to view the display members on a timepiece clearly.

The dials of many timepieces are not circular, and it is advantageous to have solutions for occupying all the available surface for an even clearer view.

The design of display mechanisms with variable geometry makes it possible to break up some of the monotony of the displays, and to liven up the display, with a different appearance according to the time of day, or at particular time periods. For example, from a very large number of other possible applications, an AM/PM display can be provided simply by the shape of a hand, which has a first appearance during the twelve hours of the morning, and a second appearance during the rest of the day; it is also possible to distinguish between day/night displays, time zone displays or others.

SUMMARY OF THE INVENTION

Resilient hands, and display mechanisms comprising such resilient hands, have been disclosed in European Patent Nos. EP2863274, EP3159751 and EP18186552, which disclose numerous variants.

The invention proposes to further simply such a mechanism and to make it even more compact and economical to produce.

To this end, the invention concerns a timepiece display mechanism with variable geometry according to claim 1.

The invention concerns a timepiece movement including at least one such display mechanism.

The invention concerns a watch including at least one such movement and/or at least one such display mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Patent Application No. EP18186552, incorporated herein by reference, relating to a timepiece display mechanism with variable geometry and a resilient hand, discloses a first actuation mechanism using wheel sets with shaped toothings. Such an embodiment makes it possible to produce very innovative displays in horology, but is, however, expensive and reserved for luxury timepieces.

The same Application also discloses a second type of actuation mechanism using a first differential on the train of the first pipe and a second differential on the train of the second pipe, and at least one cam forming an input of such a differential. Consequently, it is necessary to find a planetary gear (differential) of suitable dimensions. Planetary gears have the advantage of achieving high gear ratios in a compact space. The input and output shafts are in the extension of one another. There is a very large number of possible gear combinations. In particular, they can produce advantageous gear boxes. In the present case, it is a question of controlling one of the differential inputs, in order to generate an advance and respectively a lag of an equivalent specific value at each of the ends of the hand. And, when this value is zero, a transmission ratio of 1 must be obtained (the positive value means that the direction must also be identical).

Figure 8:
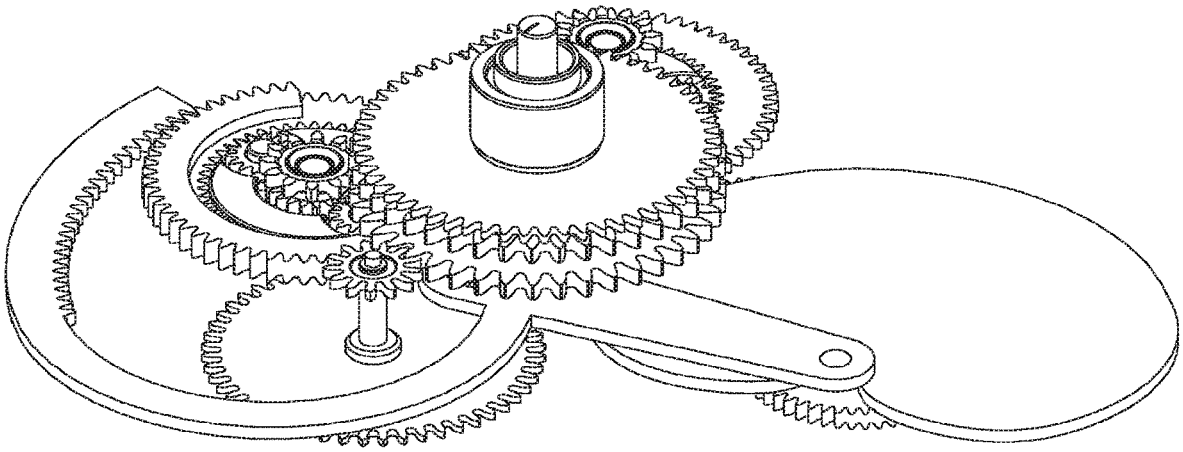
FIG. 8 represents a partial schematic perspective view of a differential mechanism according to the teachings of European Patent Application No. EP18186552.
Figure 9:
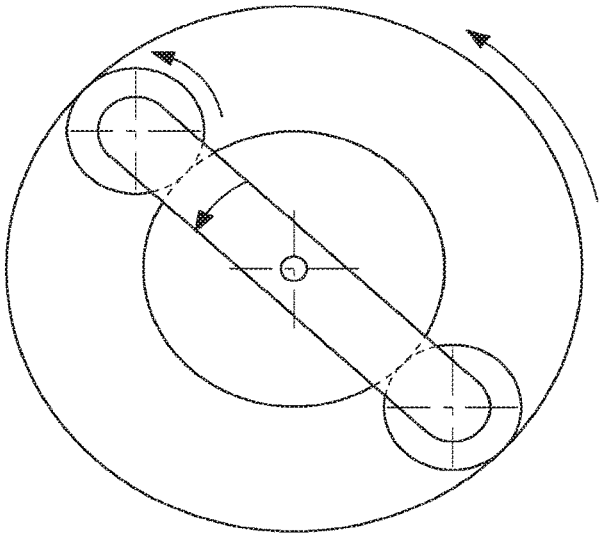
FIG. 9 is a schematic diagram of a differential of a FIG. 8 mechanism.

FIG. 8 shows an example of such an embodiment, with a heart cam on the right part of the Figure, traversed by a curved, sickle-shaped lever having an internally toothed portion, with which a wheel of a first differential cooperates, on the left part of the Figure, a second differential being visible in the back right part of the Figure, these two differentials engaging with two coaxial pipes. The lever in this Figure has no return spring, since it is the resilient hand that advantageously performs this function. The lever actuates the crown which, via planets visible in the schematic diagram of one of the two differentials, generates the required advance or lag.

This FIG. 8 mechanism satisfactorily performs the function of generating advance or lag on the pipes but remains voluminous and comprises many components.

The invention proposes to further simplify the mechanism and to make it even more compact and economical to produce. In particular, when the resilient hand is to be placed on a small calibre, such as a ladies' watch, and especially on the minute hand, the main difficulty relates to the low torque available. It is therefore necessary to create a mechanism with the lowest possible energy consumption.

By diverging from the normal operation of a differential, the invention proposes to control the planet. By inserting a feeler in the planet and controlling the latter via a round cam, we obtain a gear ratio equal to one between the sun wheel and the planet carrier frame: the assembly then behaves like a wheel and pinion.

Replacing the round cam of this example with a suitably shaped cam henceforth makes it possible to control the advance or lag that we wish to obtain on the pipe. It is to be noted that, here too, the mechanism has no return spring to maintain the contact of the feeler on the cam, since it is the resilient hand which performs this function.

In the case of a single frame carrying the two planets of the first and second differential, one above the frame for the second pipe, and the other below the frame for the first pipe, we obtain a system capable of reproducing the same advances and lags as the mechanism of Patent No. EP18186552 or of the present FIG. 8, with only four toothings.

Figure 2:
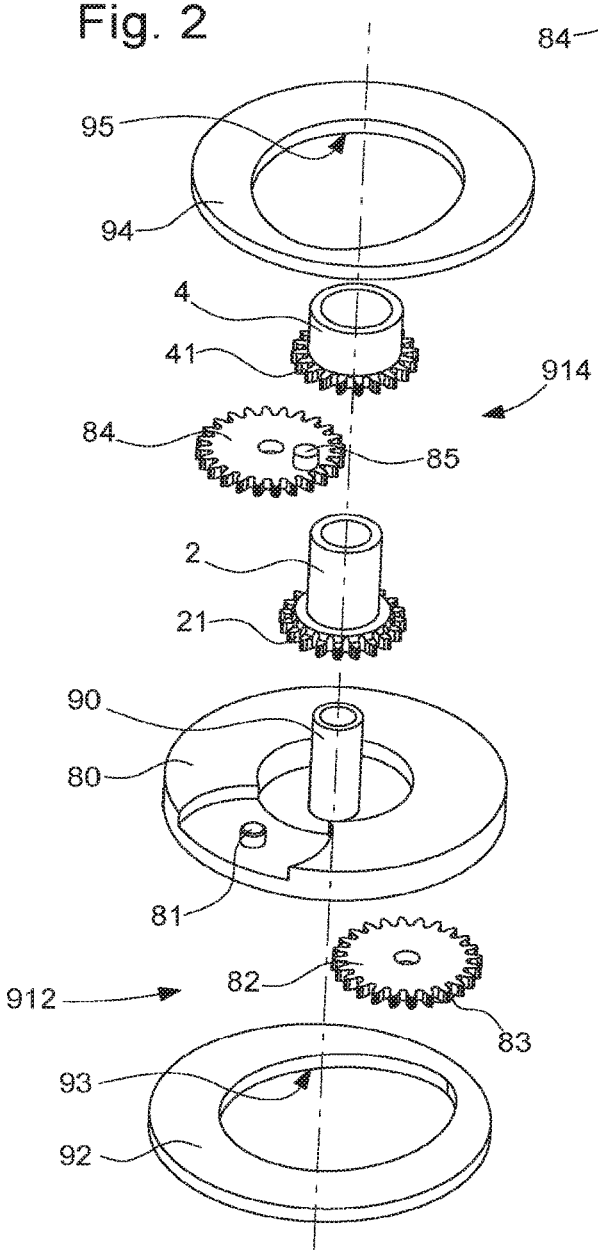
FIG. 2 represents a schematic exploded perspective view of the mechanism of FIG. 1.
Figure 5:
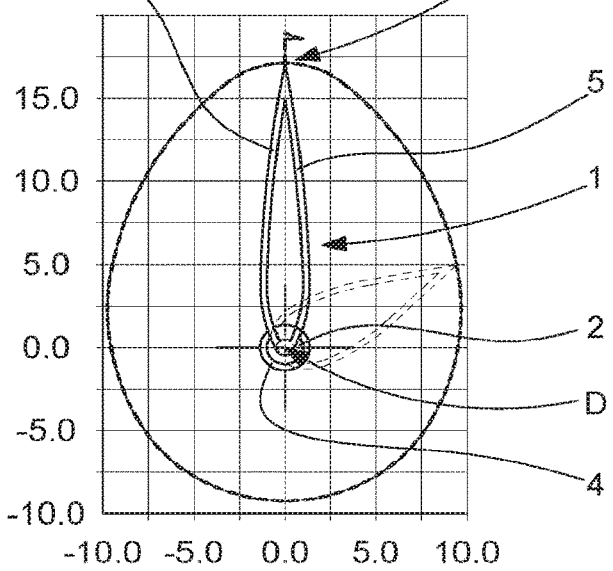
FIG. 5 represents a schematic plan view of an oval dial over which moves a resilient hand comprised in such a display mechanism, which hand is represented in two different positions: in a solid line at twelve o'clock and in a dotted line at two o'clock.

Using the cams represented in FIG. 2, it is thus possible to obtain the trajectory of the tip of the hand of FIG. 5.

The invention therefore more particularly concerns a timepiece display mechanism 10 with variable geometry including at least one resilient hand 1.

Such a resilient hand, and display mechanisms comprising such resilient hands, have been disclosed in European Patent Nos. EP2863274, EP3159751 and EP18186552, which disclose numerous variants.

This resilient hand has a first drive pipe 2 integral with a first end of a flexible strip 3, and a second drive pipe 4 integral with another end of flexible strip 3.

Figure 6:
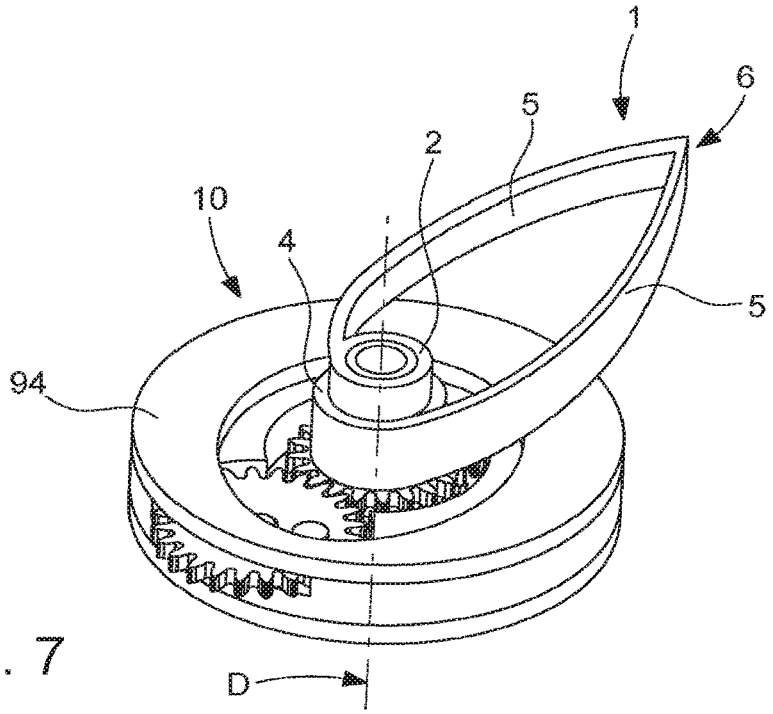
FIG. 6 represents a partial schematic perspective view of a display mechanism according to the invention, with the resilient hand on its pipes.
Figure 7:
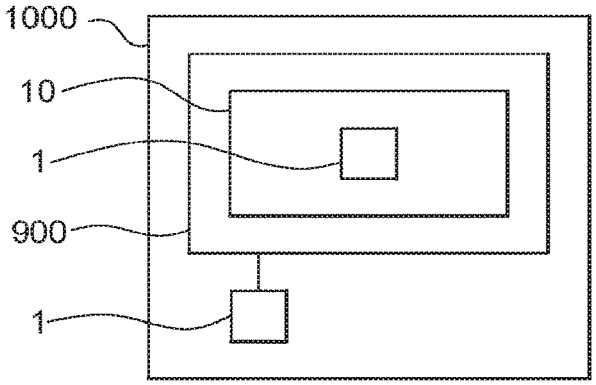
FIG. 7 is a block diagram of a timepiece including a movement and such a display mechanism.

This flexible strip 3 may be a continuous strip, or a strip comprising a succession of segments 5 joined two-by-two at tips 6, as seen in FIGS. 5 and 6. This flexible strip 3 comprises a display index which, in an unconstrained free state of resilient hand 1 in which first pipe 2 and second pipe 4 are not subject to any stress and are distant from each other, is distant from first pipe 2 and second pipe 4, the operating position of resilient hand 1 being a stressed position in which first pipe 2 and second pipe 4 are coaxial to one another about an output axis D. In particular, in a variant comprising segments 5 joined end-to-end, the display index is advantageously, but not necessarily, formed by a tip 6.

Display mechanism 10 comprises first means 11 for driving first pipe 2 about output axis D and second means 13 for driving second pipe 4 about output axis D.

Variants wherein first pipe 2 and second pipe 4 are not coaxial are not described here, but remain possible for some special displays, particularly displays which are not on a full revolution, such as retrograde displays or similar.

First drive means 11 and second drive means 13 are arranged to deform flexible strip 3, by varying the angular position of second pipe 4 with respect to the angular position of first pipe 2 about output axis D, and to vary the radial position of the display index with respect to output axis D.

According to the invention, display mechanism 10 comprises a first differential 912 on the drive train of first pipe 2, one input of which is formed by a first cam 92 or 820, and a second differential 914 on the drive train of second pipe 4, one input of which is formed by a second cam 94 or 810. Depending on the configuration adopted, the first cam may be a fixed cam or a movable cam, and the second cam may be, likewise, a fixed cam or a movable cam. FIGS. 10, 12, 14, 16 illustrate certain particular configurations.

Advantageously, first differential 912 and second differential 914 have a common planet carrier frame or two synchronous planet carrier frames, carrying planets 82, 84, which each have an off-centre feeler 83, 85, which is arranged to follow its respective cam 92, 820, 94, 820, depending on the variant.

Figure 1:
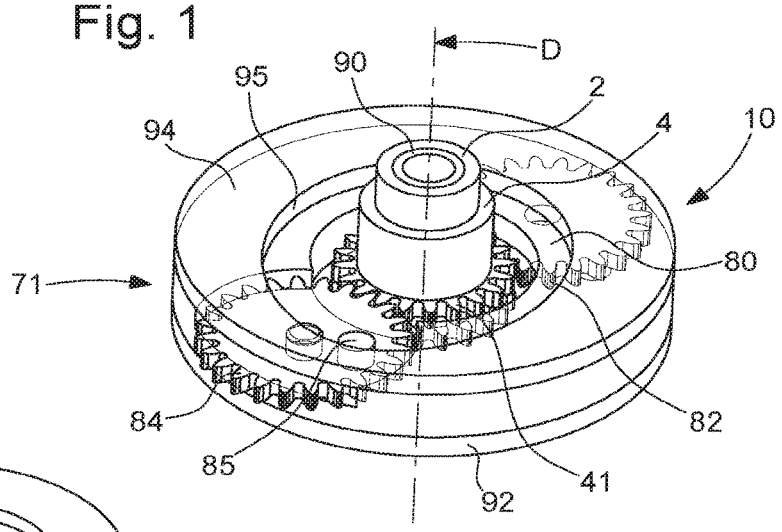
FIG. 1 represents a partial schematic perspective view of a display mechanism according to the invention, limited to the pipes of the resilient hand which is not represented; this mechanism comprises two differentials carried by a planet carrier frame movable between two fixed flanges carrying the input cams of the differentials, and the assembly thus represented constitutes an additional unit that can be adapted to an existing movement; the two pipes of the resilient hand are coaxial here around a cannon-pinion arranged to form an output of such a movement.

More particularly, first drive means 11 or second drive means 13 are arranged to drive another input of an input differential, which is a different input from the cam referred to above forming one of the inputs of the differential concerned. This input differential is one of first differential 912 or second differential 914; for example, in the variant of FIGS. 1 and 2, the input differential is second differential 914.

This other input is formed by a first planet of the input differential. The first planet is mounted to rotate freely on an input planet carrier frame 80, which is itself mounted to rotate freely about output axis D. And the sun pinion of the input differential is formed, either by a first toothing 21 carried by first pipe 2 when the input differential is first differential 912, or by a second toothing 41 carried by second pipe 4 when the input differential is second differential 914. A 'planet carrier frame' means a frame able to carry at least one planet on any of its faces.

More particularly, the other of first differential 912 and second differential 914 is an output differential, another input of which is formed by a second planet of the output differential. This second planet is mounted to rotate freely on the input planet carrier frame 80 as in FIG. 2, or on an output planet carrier frame which is mounted to rotate freely about output axis D and synchronous with input planet carrier frame 80. The sun pinion of the output differential is formed by a second toothing 41 carried by second pipe 4 when the input differential is first differential 912, or by a second toothing 21 carried by first pipe 2 when the input differential is second differential 914.

Figure 3:
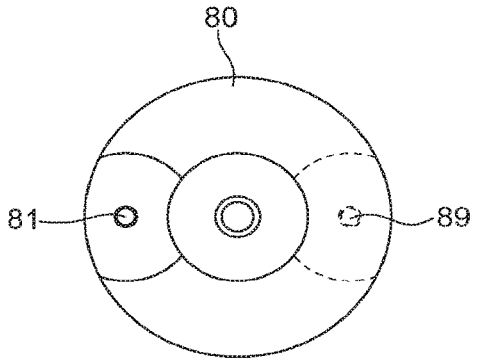
FIG. 3 represents a schematic plan view of the movable planet carrier frame comprised in this mechanism.
Figure 4:
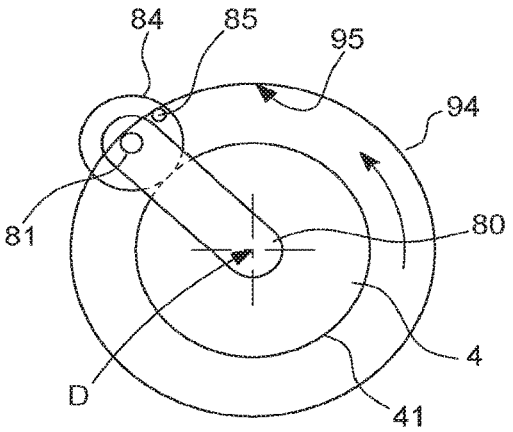
FIG. 4 is a schematic diagram of a differential of the type comprised in this mechanism.

More particularly, the second planet is mounted to rotate freely on planet carrier frame 80, on the face opposite that which carries the first planet, as seen in FIGS. 2 and 3, which show planet carrier frame 80 with counterbores in the upper and lower faces, and upper 81 and lower 91 pivot pins.

More particularly, first differential 912 comprises a first planet 82 comprising a first off centre finger 83, which is arranged to traverse a first inner path 93 of first cam 92 or 820, notably a fixed cam, and is pressed against first inner path 93 by the resilience of resilient hand 1. Likewise, second differential 914 comprises a second planet 84 comprising a second off-centre finger 85, which is arranged to traverse a second inner path 95 of second cam 94 or 810, notably a fixed cam, and which is pressed against second inner path 95 by the resilience of resilient hand 1. It is advantageous to use the resilience of resilient hand 1 itself to avoid using a return component which would be necessary to press each feeler onto its cam path.

It is understood that the relative arrangement of cams 92, 820, 94, 810 may be achieved in various ways:

- either at least one of the cams is distinct from the common planet carrier frame or from two synchronous planet carrier frames;
- or the two cams are distinct from each other and each distinct from the common planet carrier frame or from the two synchronous planet carrier frames;
- or at least one of the cams is carried by the common planet carrier frame or one of the two synchronous planet carrier frames.

In a particular embodiment, to form an additional, easy-to-assembly unit, first cam 92 or 820, notably a fixed cam, is fixed in an indexed manner to second cam 94 or 810, notably a fixed cam, with which it forms a case. This case contains first pipe 2, second pipe 4, and, inserted to rotate freely between first cam 92 or 820, notably a fixed cam, and second cam 94 or 810, notably a fixed cam, either a single input planet carrier frame 80 carrying all the wheel sets of first differential 912 and of second differential 914, or an input planet carrier frame 80 carrying all the wheel sets of first differential 912 and an output planet carrier frame mounted to rotate freely about output axis D and synchronous with input planet carrier frame 80 and carrying all the wheel sets of second differential 914.

More particularly still, the first planet projects radially with respect to output axis D and with respect to first cam 91 or 820, notably a fixed cam, and to second cam 94 or 810, notably a fixed cam, and is arranged to cooperate with an internally toothed ring, comprised in display mechanism 10, to drive this at least one resilient hand 1.

The implementation of the invention makes it possible to obtain a large variety of different displays, depending on the kinematics imposed on the cams and the planet carrier frame or planet carrier frames when there are several.

Indeed, it is possible to impose a stoppage on some of these components, which may be a permanent stoppage with permanent attachment to a plate, bridge or suchlike, or which may be a controlled stoppage of the wheel set concerned, which can be released and set in rotation by the user or by the movement for a limited or unlimited duration, to temporarily obtain a particular display effect.

Figure 10:
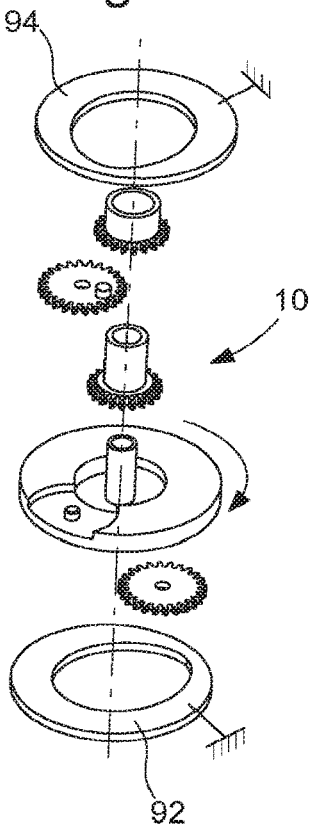
FIG. 10 represents, in a similar manner to FIG. 2, such a display mechanism, whose cams are fixedly held.
Figure 11:
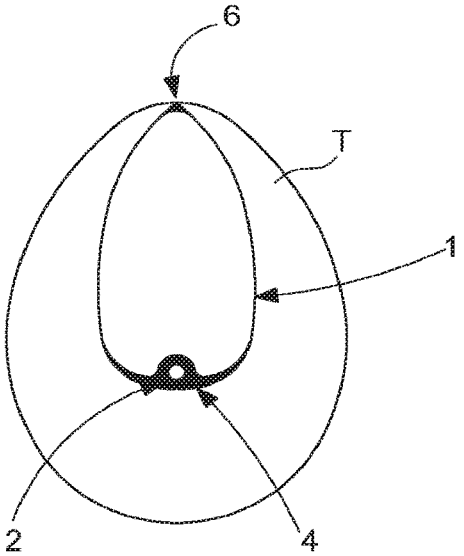
FIG. 11 illustrates, in a similar manner to FIG. 5, the associated ovoid trajectory of a tip of the resilient hand.

Thus, in a variant illustrated in FIG. 10, first cam 92 or 820 and second cam 94 or 810 are fixed with respect to a plate or a bridge comprised in the display mechanism, and the common planet carrier frame 80 in the present case, or the two synchronous planet carrier frames in another non-illustrated variant, is or are driven by a control mechanism of display mechanism 10. FIG. 11 shows the ovoid trajectory T of a tip 6 of the hand 1 associated with this mechanism.

In another variant, first cam 92 or 820 and second cam 94 or 810 pivot and are synchronous.

Figure 12:
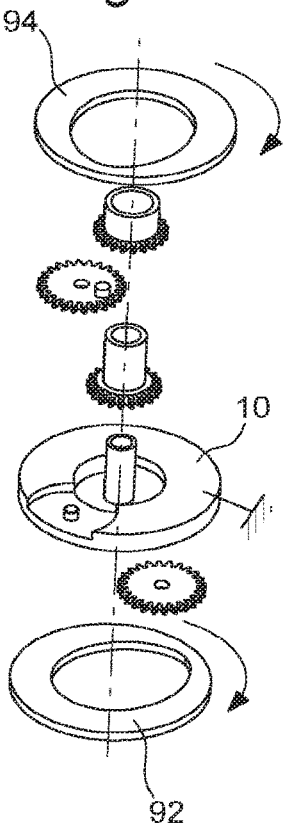
FIG. 12 represents, in a similar manner to FIG. 2, such a display mechanism, whose planet carrier frame is fixedly held, preventing the rotation of the resilient hand about its output axis and allowing only the elongation or contraction thereof.
Figure 13:
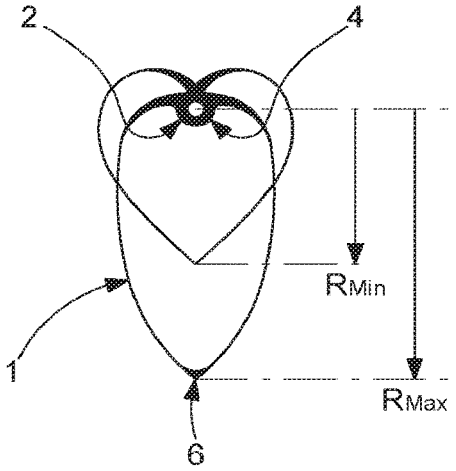
FIG. 13 illustrates, in a similar manner to FIG. 5, the associated trajectory of a tip of the resilient hand, which successively takes almond and heart shapes.

Thus, in a variant illustrated in FIG. 12, first cam 92 or 820 and second cam 94 or 810 pivot and are synchronous, and the common planet carrier frame 80 illustrated, or the two synchronous planet carrier frames, is or are fixed with respect to a plate or a bridge comprised in display mechanism 10. FIG. 13 shows the linear trajectory of a tip 6 of the hand 1 associated with this mechanism, since this resilient hand 1 does not rotate here about output axis D, but changes length according to the shape of the cams, between a minimum radius RMIN and a maximum radius RMAX; one application consists, for example, of a linear power reserve display.

Figure 14:
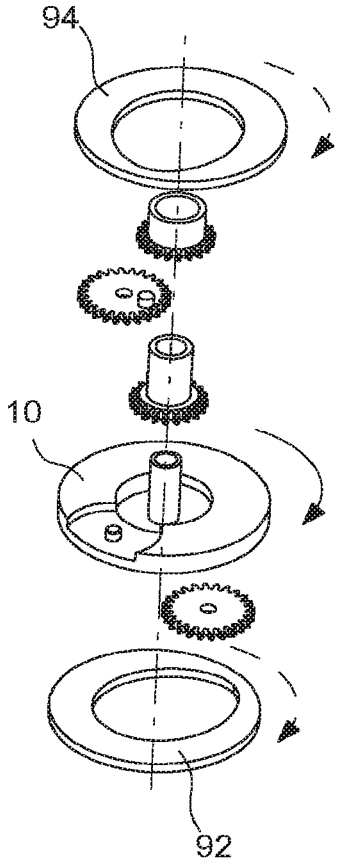
FIG. 14 represents, in a similar manner to FIG. 2, such a display mechanism, whose cams are, on demand, either fixedly held, or set in motion, particularly in a limited manner.

In yet another variant illustrated in FIG. 14, first cam 92 or 820 and second cam 94 or 810 pivot and can be locked in a fixed position, but non-permanently, since they can make a rotational motion on demand, particularly, but not exclusively, of one revolution or of an integer number of revolutions. Here, first cam 92 or 820 and second cam 94 or 810 pivot and are synchronous and the common planet carrier frame 80 illustrated, or the two synchronous planet carrier frames, in another non-illustrated variant, pivot coaxially with respect to first cam 92 or 820 and second cam 94 or 810. More particularly, display mechanism 10 then comprises an on-demand control mechanism for pivoting together first cam 92 or 820 and second cam 94 or 810, and for varying the radial extension of resilient hand 1 with respect to output axis D.

Figure 15:
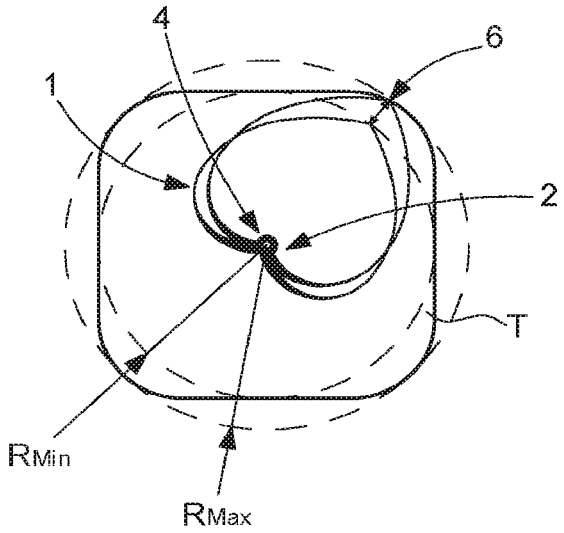
FIG. 15 illustrates, in a similar manner to FIG. 5, the associated trajectory of a tip of the resilient hand, in a square with rounded corners when the cams are stopped, and in a radial line when the cams are rotating.

FIG. 15 shows the square trajectory T of a tip 6 of hand 1 associated with the FIG. 14 mechanism. This tip 6 is separated from output axis D by a distance which varies between a minimum radius RMIN and a maximum radius RMAX. During operation, when cams 92 or 820 and 94 or 810 are stopped, this tip 6 follows the square trajectory with rounded corners T. When the cams are rotated, hand 1 always points in the same direction, but changes length, like a cardiac pulse: hand 1 is in the shape of a heart here which beats on demand.

Figure 16:
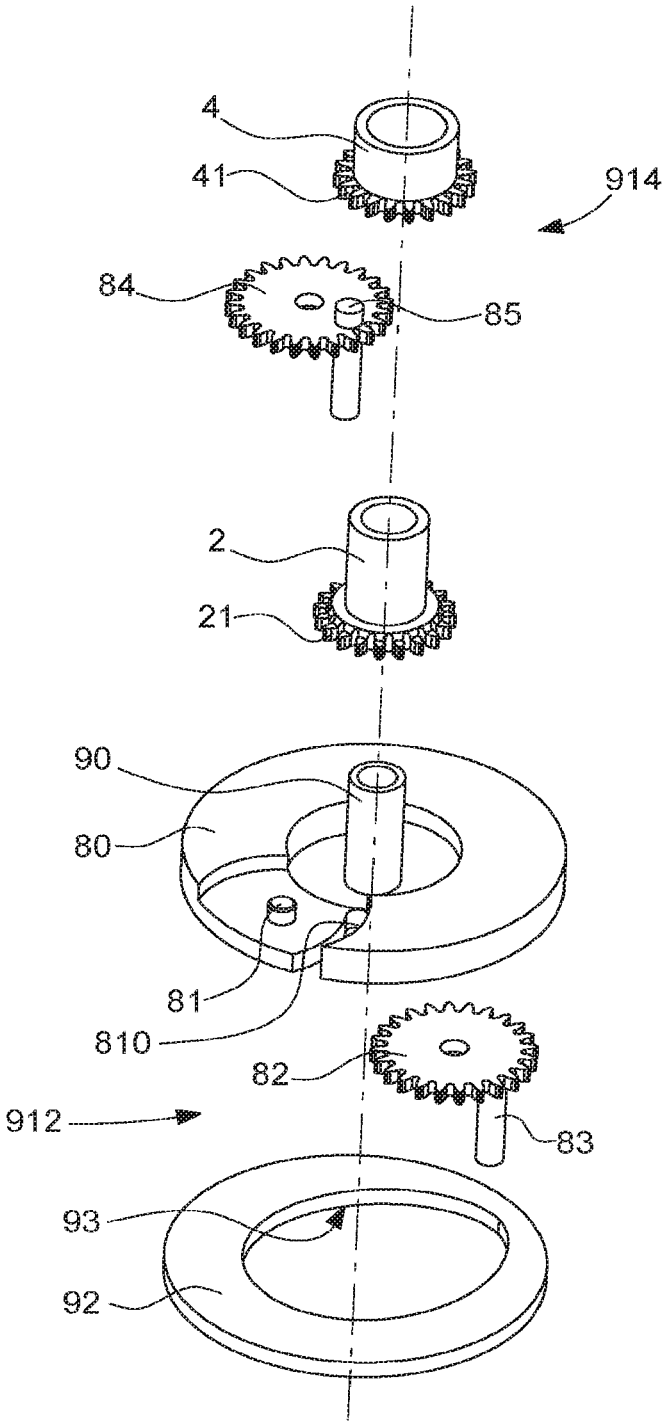
FIG. 16 illustrates, in a similar manner to FIGS. 10, 12 and 14, another variant wherein one of the cams is carried by the planet carrier frame.

FIG. 16 illustrates, in a similar manner to FIGS. 10, 12 and 14, another variant wherein one of the cams, here second cam 810, is carried by planet carrier frame 80: it cooperates with the second off-centre finger 85 of second planet 84, which is carried by pivot pin 81 of the same planet carrier frame 80; on the lower face of this planet carrier frame 80, first planet 82 is similarly guided and its first off-centre finger 83 cooperates with first inner path 93 of first cam 92. Naturally, the symmetrical configuration can be achieved with a first cam 820 arranged on planet carrier frame 80 and a second cam 94 outside the latter.

The invention also concerns a timepiece movement 900 including at least one display mechanism 10 of this type.

The invention also concerns a watch 1000 including at least one such movement 900, and/or at least one such display mechanism 10.

In short, the invention makes it possible to generate advance or lag on the two pipes of the resilient hand, allowing complex trajectories to be produced, all in a very simple, compact manner, which uses low torque and is therefore very reliable.

The invention claimed is:

1. A timepiece display mechanism of variable geometry, comprising at least one resilient hand, which includes a first drive pipe integral with a first end of a flexible strip and a second drive pipe integral with another end of said flexible strip, and comprising a display index which, in an unconstrained free state of said resilient hand wherein said first pipe and said second pipe are not subject to any stress and are distant from one another, is distant from said first pipe and said second pipe, the operating position of said resilient hand being a constrained position wherein said first pipe and said second pipe are coaxial to one another about an output axis, said display mechanism comprising first means for driving said first pipe about said output axis and second means for driving said second pipe about said output axis, said first drive means and second drive means being arranged to deform said flexible strip, by varying the angular position of said second pipe with respect to the angular position of said first pipe about said output axis, and to vary the radial position of said display index with respect to said output axis, wherein said display mechanism comprises a first differential on the drive train of said first pipe having one input which is formed by a first cam, and a second differential on the drive train of said second pipe having one input which is formed by a second cam, and wherein said first differential and said second differential carry planets each comprising an off-centre feeler arranged to follow its respective cam.

2. The display mechanism according to claim 1, wherein said second cam is synchronous with said first cam.

3. The display mechanism according to claim 1, wherein said first differential and said second differential have a common planet carrier frame or two synchronous planet carrier frames, each carrying planets, which each have an off-centre feeler arranged to follow its respective cam.

4. The display mechanism according to claim 3, wherein at least one of said cams is distinct from said common planet carrier frame or from said two synchronous planet carrier frames.

5. The display mechanism according to claim 4, wherein both of said cams are distinct from each other and from said common planet carrier frame or from said two synchronous planet carrier frames.

6. The display mechanism according to claim 3, wherein at least one of said cams is carried by said common planet carrier frame or one of said two synchronous planet carrier frames.

7. The display mechanism according to claim 1, wherein said first cam and said second cam are fixed with respect to a plate or a bridge comprised in said display mechanism, and wherein said common planet carrier frame or said two synchronous planet carrier frames is or are driven by a control mechanism of said display mechanism.

8. The display mechanism according to claim 1, wherein said first cam and said second cam pivot and are synchronous, and wherein said common planet carrier frame or said two planet carrier frames is or are fixed with respect to a plate or a bridge comprised in said display mechanism.

9. The display mechanism according to claim 8, wherein said display mechanism comprises an on-demand control mechanism for pivoting together said first cam and said second cam, and for varying the radial extension of said resilient hand with respect to said output axis.

10. The display mechanism according to claim 1, wherein said first cam and said second cam pivot and are synchronous, and wherein said common planet carrier frame or said two synchronous planet carrier frames pivot coaxially with respect to said first cam and said second cam.

11. The display mechanism according to claim 10, wherein said display mechanism comprises an on-demand control mechanism for pivoting together said first cam and said second cam, and for varying the radial extension of said resilient hand with respect to said output axis.

12. The display mechanism according to claim 1, wherein said first drive means or said second drive means are arranged to drive another input of an input differential, which is one of said first differential or said second differential, formed by a first planet of said input differential, said first planet being mounted to rotate freely on an input frame mounted to rotate freely about said output axis, and the sun pinion of said input differential being formed by a first toothing carried by said first pipe when said input differential is said first differential, or by a second toothing carried by said second pipe when said input differential is said second differential.

13. The display mechanism according to claim 12, wherein the other of said first differential and second differential is an output differential, another input of which is formed by a second planet of said output differential, said second planet being mounted to rotate freely on said input frame or on an output frame mounted to rotate freely about said output axis and synchronous with said input frame, and the sun pinion of said output differential being formed by a second toothing carried by said second pipe when said input differential is said first differential, or by a first toothing carried by said first pipe when said input differential is said second differential.

14. The display mechanism according to claim 13, wherein said second planet is mounted to rotate freely on said input frame, on the face opposite to that which carries said first planet.

15. The display mechanism according to claim 12, wherein said first planet projects radially with reference to said output axis and with respect to said first fixed cam and to said second fixed cam, and is arranged to cooperate with an internally toothed ring, comprised in said display mechanism, for driving said at least one resilient hand.

16. The display mechanism according to claim 1, wherein said first differential includes a first planet comprising a first off-centre finger arranged to traverse a first inner path of said first cam and pressed against said first inner path by the resilience of said resilient finger, and wherein said second differential comprises a second planet comprising a second off-centre finger arranged to traverse a second inner path of said second cam and pressed against said second inner path by the resilience of said resilient hand.

17. The display mechanism according to claim 1, wherein said first cam is fixed in an indexed manner to said second cam with which it forms a case containing said first pipe, said second pipe, and, inserted to rotate freely between said first cam and said second cam, either a single input frame carrying all the wheel sets of said first differential and of said second differential, or an input frame carrying all the wheel sets of said first differential and an output frame mounted to rotate freely about said output axis and synchronous with said input frame and carrying all the wheel sets of said second differential.

18. A timepiece movement including at least one display mechanism according to claim 1.

19. A watch comprising at least one movement according to claim 18.

* * * * *